US005392956A

United States Patent [19]

Keller

[11] Patent Number: 5,392,956

[45] Date of Patent: Feb. 28, 1995

[54] METHOD FOR THE ADVANCE OF A PLURALITY OF RODS, IN PARTICULAR FOR MANUALLY OPERATED DISPENSING APPLIANCES

[76] Inventor: Wilhelm A. Keller, Obstgartenweg 9, CH-6402 Merlischachen, Switzerland

[21] Appl. No.: 114,903

[22] Filed: Sep. 2, 1993

[30] Foreign Application Priority Data

Sep. 2, 1992 [CH] Switzerland ..... 02 758/92-2

[51] Int. Cl.[6] ..... B67D 5/42

[52] U.S. Cl. ..... 222/1; 222/137; 222/391

[58] Field of Search ..... 222/1, 137, 391

[56] References Cited

U.S. PATENT DOCUMENTS

| | | | |
|---|---|---|---|
| 3,311,265 | 3/1967 | Creighton, Jr. et al. | 222/391 X |
| 4,471,888 | 9/1984 | Herb et al. | 222/391 X |
| 4,566,610 | 1/1986 | Herb | 222/391 X |
| 4,655,372 | 4/1987 | Ross et al. | 222/391 |
| 5,137,181 | 8/1992 | Keller | 222/137 |
| 5,197,635 | 3/1993 | Chang | 222/137 |
| 5,203,476 | 4/1993 | Keller | 222/136 |
| 5,263,614 | 11/1993 | Jacobsen et al. | 222/137 |

FOREIGN PATENT DOCUMENTS

| | | | |
|---|---|---|---|
| 245198 | 5/1963 | Australia | 222/391 |
| 0294672 | 5/1988 | European Pat. Off. . | |
| 0408494 | 7/1990 | European Pat. Off. . | |
| 3128611 | 1/1983 | Germany . | |
| 1011470 | 12/1965 | United Kingdom | 222/391 |

*Primary Examiner*—David M. Mitchell
*Assistant Examiner*—Kenneth Bomberg
*Attorney, Agent, or Firm*—Marks & Murase

[57] ABSTRACT

A method for the advance of two or more rods against a resistance, as it is typically required in dispensing appliances for multiple component dispensing cartridges, consists in that thrust rods are seized by clamping levers in a traveller and then are advanced along with the traveller. The thrust rods extend through guides in traveller on both sides of the respective clamping lever as well as through a bore in the clamping lever. By a transmission of the advancing motion to the clamping levers, which is offset with respect to the bore, the latter are pivoted perpendicularly to the bore, whereby the thrust rods are clamped in the bores and are driven along. The clamping levers are arranged in such a manner that the torsional moments of the clamping action are essentially equal and opposed, whereby no torsional moment acts upon the traveller as a whole. Furthermore, clamping levers are provided in order to constantly seize both of the thrust rods as precisely simultaneously as possible, independently from manufacturing tolerances or wear. The method serves especially for advance of the thrust rods in manual dispensing appliances for dispensing cartridges, even for cartridges with mixing ratios which are far from 1:1.

19 Claims, 4 Drawing Sheets

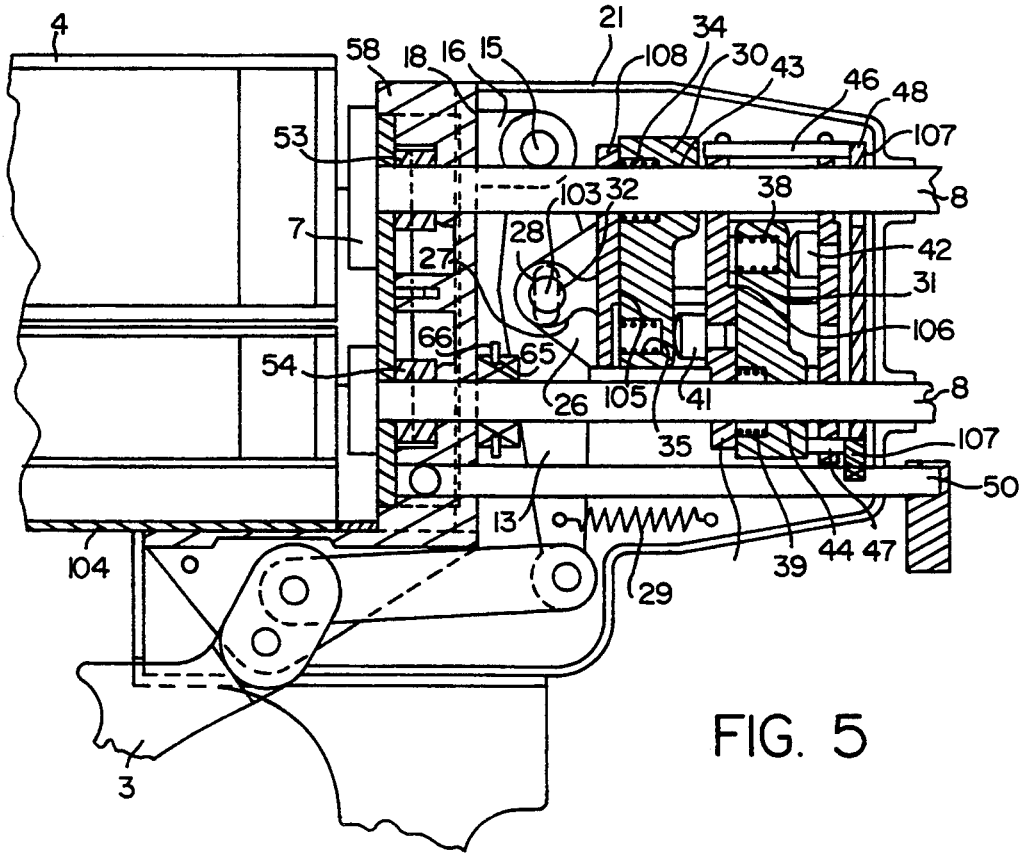
FIG. 5
FIG. 4
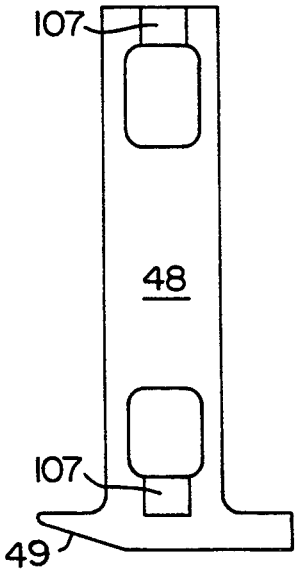
FIG. 6
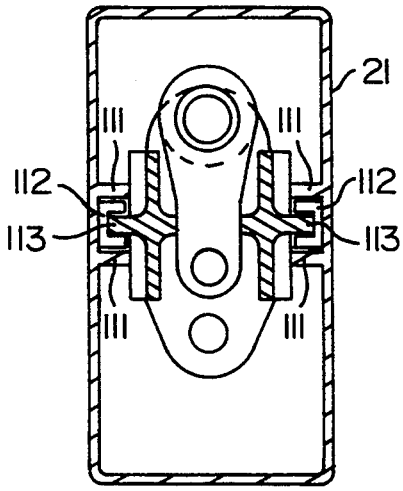

METHOD FOR THE ADVANCE OF A PLURALITY OF RODS, IN PARTICULAR FOR MANUALLY OPERATED DISPENSING APPLIANCES

BACKGROUND OF THE INVENTION

The present invention refers to a method for the even advance of at least one thrust rod in a dispensing appliance comprising a traveller against an advancing resistance, and to a device for carrying out said method, more particularly for application in a manually operated dispensing appliance for two-component substances. Such an appliance is known for example from DE-A-3,128,611. In the latter, the thrust rods are actuated through respective clamping jaws via a yoke by a handlever, and for the lateral support of the thrust rods, a counter-bearing is provided on which said clamping jaws are hinged, while the advance drive comprises a relatively complicated traveller.

EP-A-408 494 discloses a manually operated appliance in which a bending and canting of the thrust rods is effectively prevented by the fact that the advancing drive actuates a thrust member which essentially acts upon said thrust rods only in the direction of the latter, the force transmission being obtained by toothed bars, however.

BACKGROUND OF THE INVENTION

On the background of the cited state of the art, it is the object of the present invention to indicate a method in which the advancing drive is effective even under high forces without any dead travel, thus providing a flawless force transmission. More particularly, when using double dispensing cartridges having different diameters, where different reaction forces act upon the thrust rods, the invention aims to prevent that a relative displacement of the thrust rods with respect to each other occurs, thus preventing any variation of the volumetric mixing ratio. This object is attained by the method of the invention, wherein each thrust rod is guided in bores of said traveller and passes through a bore of one of the clamping levers which are movably mounted in said traveller, said clamping lever tilting with respect to said thrust rod passing therethrough around an axis which is perpendicular to said thrust rod and clamping said thrust rod in said bore, the bending moment which is thereby imparted to said thrust rod being received by the guidings of said thrust rod in said traveller, and the torsional moments in said traveller resulting from the clamping cancelling each other when the advance resistances of said thrust rods are equal. The further claims comprise devices for carrying out the method of the invention.

Accordingly, said thrust rods are guided in a traveller which is movable in the direction of the advance of the dispensing pistons and which comprises two clamping levers which are only loosely held in said traveller. Said clamping levers each comprise a passage for one of said thrust rods. In a forward motion of said traveller, i.e. in the dispensing direction, said clamping levers are driven in an offset manner with respect to said passage, thus resulting in a torsional moment which leads to a canting of said clamping levers on said thrust rods in the area of said passages. In the further forward motion of said traveller, said clamping levers cannot turn any further, they are driven along and thus transmit the forward ward motion to the clamped thrust rods. Since the travel of said clamping levers until the clamping action is obtained appears as dead travel from the outside, suitable measures have to be taken to provide that said travel is small, such as adjusting said clamping lever passages for said thrust rods, hard surfaces etc. Differences of said dead travel of said clamping levers are rendered ineffective by the fact that said clamping levers are subjected to a small, permanent clamping force, e.g. by contact springs.

According to the invention, the bending moment imparted to the thrust rods is nearly completely received by said traveller, i.e. the guiding of said traveller is not stressed by the mere clamping action. This is obtained by the fact that said thrust rods run in closely adjusted and possibly lubricated guidings inside said traveller, in the first place, and that the bending moments which produce torsional moments in said traveller by virtue of said guidings act in opposite directions. Meanwhile, the additional friction which is produced by the bending of said thrust rods does not result in a hindrance of the forward motion, but in a still better contact between said traveller and said thrust rods. In this context, as close an arrangement of the thrust rod guidings to said clamping levers in the traveller as possible is advantageous.

The traveller guidings thus only have to take up the difference of the forces acting upon the pistons, which is transmitted to the housing. With cartridges having a mixing ratio of 1:1, said difference disappears.

In order to guide said traveller, it may be sufficient only to guide said thrust rods in the housing, e.g. at their entrance and exit from the latter. It is often advisable to provide particular guidings for said traveller. The more precisely said guidings function, the less said traveller will be canted by different piston pressures, and the variations of the mixing ratio which would result therefrom are minimized. Also, said traveller guidings can be better adapted to the existing stresses, whereby the existing friction forces are reduced as compared to a guidance by means of said thrust rods.

For an easy motion and a long durability, said thrust rods, said passages of said clamping levers as well as possibly the guidings of said thrust rods in said traveller have a hard and smooth surface. The high clamping forces nevertheless provide a secure driving of said thrust rods. Smooth surfaces allow a retraction of said thrust rods requiring smaller forces in spite of the relatively numerous guidings.

Further devices which are partly known and which are advantageous in practice may be combined with the advancing device of the invention. Examples are nonreturn devices, unlockable non-return devices, and lockable clamping levers in order to allow a retraction of said thrust rods.

BRIEF DESCRIPTION OF THE DRAWINGS

The invention is further explained with reference to an embodiment thereof.

FIG. 4 shows a plan view of traveller 48;

FIG. 5 shows an enlarged detail of the appliance of FIG. 1;

FIG. 6 shows a simplified cross-section according to line V—V in FIG. 1; and

DETAILED DESCRIPTION OF THE INVENTION

Figure 1:
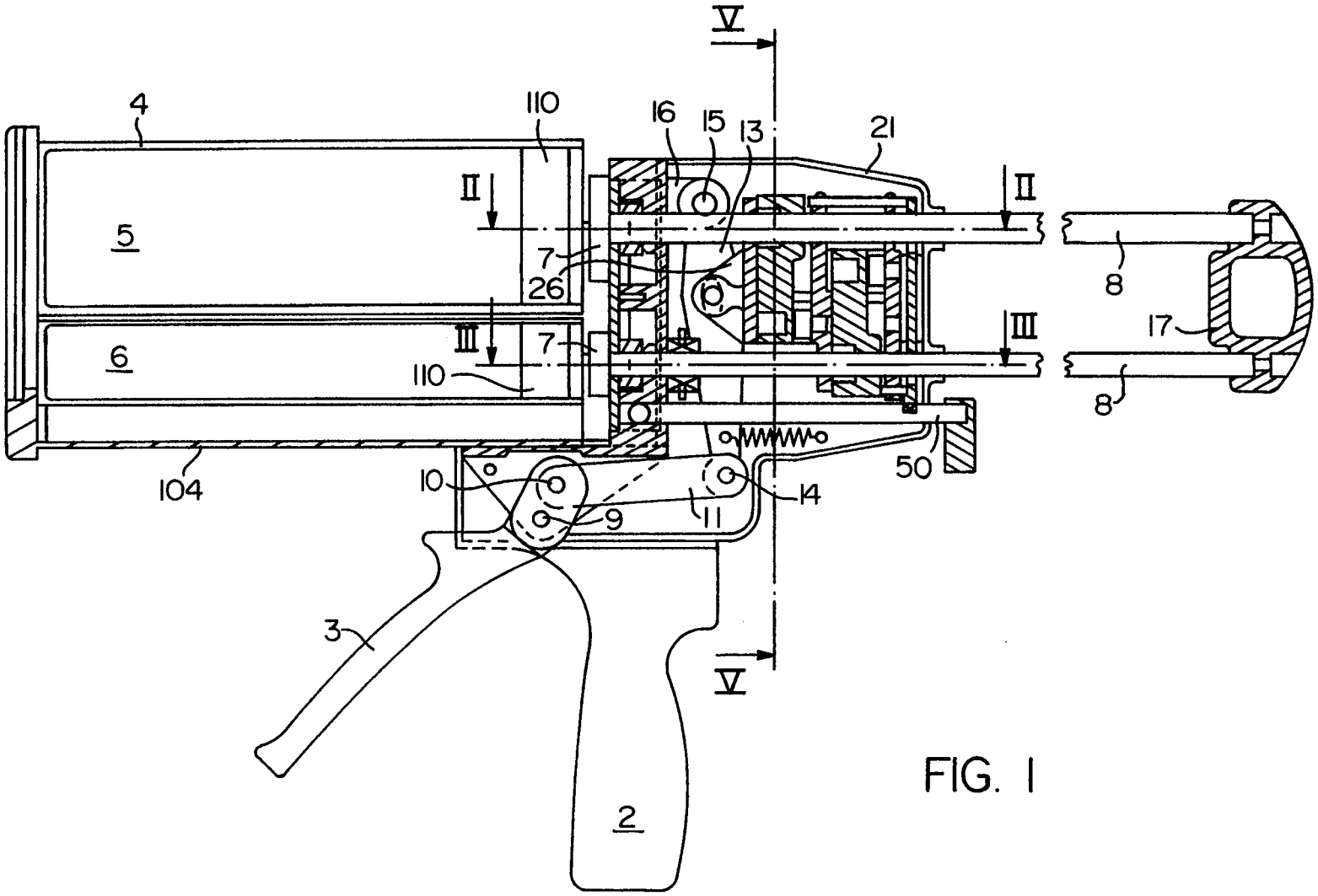
FIG. 1 shows a cross-section of an embodiment of the invention.

FIG. 1 represents a first embodiment of a manually operated appliance according to the invention, comprising a housing 21, a handle 2, a trigger lever 3, as well as double cartridge 4 with the two cylinders 5 and 6 which are only partially illustrated since they are known. During the dispensing operation, the two components of said double cartridge are mixed in an attached static mixer, whereupon they react chemically and harden or solidify. The dispensing of said two components from the cylinders is obtained by simultaneous actuation of dispensing pistons which are arranged in each cylinder, whereby the substances are pressed out through the frontal dispensing opening (not shown) of said static mixer. Double cartridge 4 is not actually an object of the present invention and has been described in detail e.g. in EP-A-294,672 to the same applicant. The manually operated appliance of the invention, however, is not limited to the actuation of such double cartridges, but it is especially suitable therefor.

As the substances to be dispensed can be quite viscous, relatively high forces have to be applied in order to dispense them. On the other hand, as precise a proportioning as possible under exact observation of the mixing ratio of the substances to be dispensed is desirable, so that high overall requirements must be met by the mechanical components of such an appliance, for the advance must be easily movable and must not jam even under high forces, on one hand, and on the other hand, it must be precise in order to prevent any relative displacement of the thrust rods. The dispensing pistons 110 comprised in the cartridges are actuated by thrust plates 7 at the ends of thrust rods 8. Said thrust rods are driven by trigger lever 3 through a lever arrangement.

Figure 2:
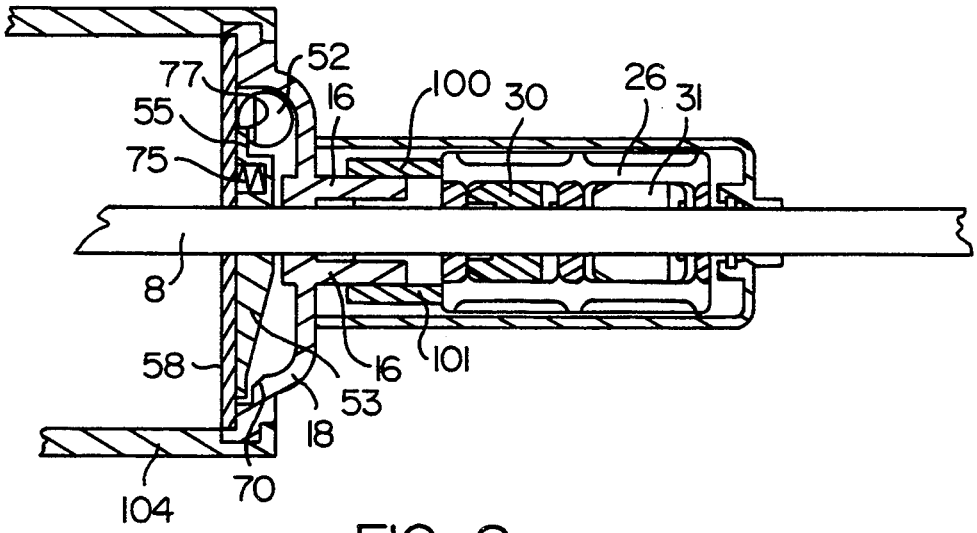
FIG. 2 shows a cross-section of the appliance of FIG. 1 according to line II—II.
Figure 3:
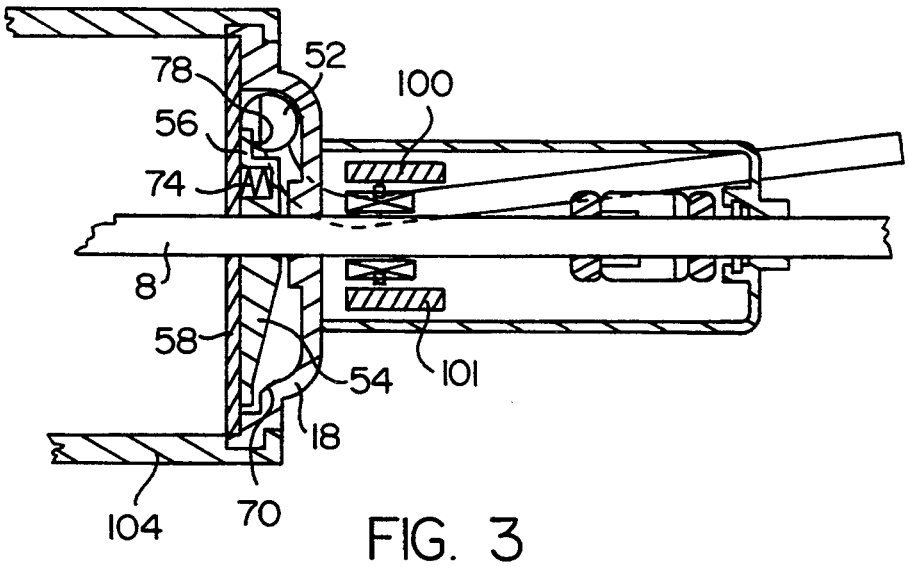
FIG. 3 shows a cross-section of the appliance of FIG. 1 according to line III—III.

Trigger lever 3, which is mounted on a hinge pin 9, is connected by bearing neck 10 to a first traction bar 11 of a traction lever 13 which is connected to traction bar 11 by a bearing neck 14 and is rotatively held in bearing block 16 by a stationary hinge pin 15. The cross-sections of FIGS. 2 and 3 show that traction lever 13 consists of two shanks 100 and 101 which are connected by axles 14 and 15 (FIG. 5). Projection 27 of traveller 26 comprises a bore 32. Traction lever parts 100 and 101 are each provided with an oblong bore 28. A bolt 103 which is flattened on both sides passes through bores 28 and bore 32, its motional component transversally to the advancing direction of traveller 26 being received by longitudinal bores 28 while it rotates in bore 32. Spring 29 returns the entire advancing device to the represented starting position when trigger lever 3 is released.

The traveller guiding can be designed as shown in FIG. 6. In housing 21 of the dispensing appliance, means 111 are provided in which inserts 112 are inserted. Corresponding means 113 of traveller 26 slide in said inserts 112. In the present example, means 111 with inserts 112 and means 113 form a tongue-and-groove sliding system. Inserts 112 here serve to increase the lifetime and to improve the mechanical properties such as reduced friction and a more precise guidance.

Clamping levers 30 and 31 are held in traveller 26. As appears especially in FIG. 5, each of said levers comprises a respective bore 43, 44 through which a respective thrust rod 8 passes. Bores 43 and 44, each have a greater cross-section portion on the front side, i.e. towards cartridge 4. In the space which is thus formed between thrust rods 8 and the wall of said bores 43 and 44, pressure springs 34 and 39, respectively, are inserted and are supported and guided by the wall of the bore in traveller 26. Near the other end of clamping levers 30 and 31, pressure springs 35 and 38, respectively, are inserted in a second bore, said springs pressing said clamping levers against opposite pegs 41 and 42, respectively, with convex surfaces and also resting on traveller 26 on the front side. In the area where thrust rod 8 is clamped, bores 43 and 44, respectively can be lined with a material, e.g. in the form of a bushing, which provides a long lifetime and a good clamping action.

In traveller 26, releasing pins 46 and 47 are guided in such a manner as to be displaceable in the advancing direction, said pins cooperating with a releasing slide 48 which rests on the back side of the manually operated appliance. Releasing rod 50 extends under releasing slide 48 and is laterally pivotable around shaft 52 according to FIG. 3.

In the front portion of housing 21, locking levers 53, 54 are arranged in the space between supporting plate 18, which is connected to cartridge holder 104, and cover plate 58. Said locking levers are tilted with respect to thrust rods 8 passing therethrough by springs 74, 75. Tongues 55, 56 of locking levers 53, 54 engage in recesses of shaft 52.

Thrust rods 8 are connected to each other at their rear ends by a bridge 17. Bridge 17 serves as a rearward termination of thrust rods 8 in view of security aspects, prevents a permanent mutual displacement of thrust rods 8, and serves as a handle for pulling back thrust rods 8 e.g. for changing cartridge 4.

When trigger lever 3 is moved in the direction of handle 2, bar 11 and, by means of lever 13, also traveller 26 are pulled forward. Meanwhile, pegs 41 and 42 first press against clamping levers 30 and 31 respectively from behind and eccentrically with respect to bores 43 and 44 and, respectively. Since in the resting position, said levers are always in contact with pegs 41 and 42 because of springs 35 and 38, on one hand, and since they are slightly preloaded with respect to the clamping of thrust rods 8 by springs 34 and 39, a clamping connection is established without any play and evenly between traveller 26 and thrust rods 8 during the advance. In the process, clamping levers 30, 31 move around edges 105 and 106, respectively. The further forward motion of traveller 26 is then transformed into an equal forward motion of thrust rods 8, thrust plates 7 and finally of dispensing pistons 110 in cartridge cylinders 5 and 6. The uniformity of the clamping action, and thus finally the uniform advance of the dispensing pistons, is particularly important in multiple component dispensing systems for the observation of a constant mixing ratio. By the construction of the invention, different manufacturing allowances as well as wear phenomena in the clamping elements are also compensated.

When a sufficient quantity of the substance has been pressed out from cartridge 4, trigger lever 3 is released, and the entire advancing device automatically returns to its resting position under the action of spring 29. As the clamping action of clamping levers 30 and 31 is cancelled during the return movement of traveller 26, thrust rods 8 are not compulsorily taken along by said return motion. Clamping levers 30, 31 are then in contact with walls 108 and 109, respectively of traveller 26 in front of them, whereby any jamming of thrust rods 8 in the return motion is avoided.

The residual friction between clamping levers 30, 31 and thrust rods 8 during the return motion of traveller 26 may possibly lead in combination with a residual pressure of the cartridge contents to a backward actuation of thrust rods 8. This is prevented by a friction brake 65 which is known per se, e.g. from European Patent Application EP-A-0,408,494 to the same applicant, consisting of a slide 65 which is displaceable on one of thrust rods 8 with a certain friction and whose movement with respect to housing 21 is limited by a stop 66. By a small free stroke corresponding to a short retraction of thrust rods 8, an afterflow of the dispensed substance can be prevented. It is sufficient if said friction brake is present on only one side since the stability of bridge 17 is sufficient in order to distribute the braking force to both thrust rods 8.

In the case of more viscous dispensing substances which are dispensed under relatively high pressures, such a simple return brake is no longer sufficient since under the required high dispensing pressure, the cartridge body will elastically deform to an unneglectable extent. At the beginning of the dispensing operation, the accompanying volumetric expansion must first be overcome before a dispensing occurs that essentially corresponds to the thrust piston advance. This initial dead travel would occur repeatedly if thrust rods 8 could move back freely when trigger lever 3 is released. Therefore, if the dispensing appliance is supposed to be useful for more viscous dispensing substances as well, a device preventing a backward motion of thrust rods 8 is very desirable.

This function is carried out by locking levers 53 and 54 which are represented in FIGS. 2 and 3 in yet another view. During the advance, they rest on plate 58, so that thrust rods 8 can slide through the corresponding bores in locking levers 53, 54 without being braked. However, when the forward motion stops, locking levers 53 and 54 are pushed backwards by contact springs 74 and 75, respectively while pivoting around edge 70. Thereby, in analogy to clamping levers 30, 31, a possible play of thrust rods 8 in the bores of locking levers 53, 54 is rendered ineffective, and both thrust rods are thus blocked as exactly simultaneously as possible. The smallest backward motion of thrust rods 8 will then immediately lead to a jamming of locking levers 53, 54 by the offset retaining force of edge 70, whereby any further backward motion of thrust rods 8 is safely prevented.

In order to exchange the cartridge, it is necessary to provide a possibility for retracting thrust rods 8. This involves bringing not only locking levers 53, 54, but also clamping levers 30 and 31 to a releasing position. To this end, releasing rod 50 is swung out of the position shown in FIG. 3. In the process, to begin with, slide 48 is moved upwards by a gliding motion of inclined portion 49 over releasing rod 50 (see FIG. 4), whereby pins 46 and 47 (see FIG. 5) are moved forward by inclined portions 107 of slide 48 and thus press clamping levers 30 and 31 into the releasing position. As locking levers 53, 54 still take up the backward pressure, only a small force is required therefor. Only when releasing rod 50 is further pivoted, tongues 55, 56 of locking levers 53 and 54, respectively are also seized by edges 77 and 78 of shaft 52 which is rotated along with releasing rod 50 and are pushed forward against plate 74 and into their releasing position, whereupon thrust rods 8 and thrust plates 7 can be retracted by pulling back bridge 17.

The risk that locking levers 30, 31 are also jammed by a fast manual advance of thrust rods 8 is obviated by the fact that clamping levers 30, 31 abut to the wall of traveller 26 in front of them before a clamping action acting in the forward direction becomes effective.

Of the two return stops indicated in the embodiment, both can be present or one can be omitted, i.e. only the friction brake or only the locking lever brake may be present. Said friction brake might also be multiple, in particular one for each thrust rod. In this case, it might be formed of a plurality of friction bodies or of a single, larger one which surrounds the thrust rods. Said friction brake might also be secured without any play with respect to the housing of the dispensing appliance in order to prevent any free back-run. Instead of the two described locking levers, a single locking lever may be provided, the locking effect then being transmitted to the other thrust rod(s) which is (are) not seized by said locking lever by bridge 17.

A further position of said releasing rod might be provided in which locking levers 53, 54 are pushed into the releasing position, but in which clamping levers 30, 31 remain free, i.e. slide 48 is not lifted. In this position, only said friction return stop is thus active, whereby the dispensing appliance can quickly be changed from dispensing highly viscous to dispensing less viscous substances.

Alternatively, locking means such as clamping screws which push locking levers 53, 54 into the releasing position would be possible.

Figure 7:
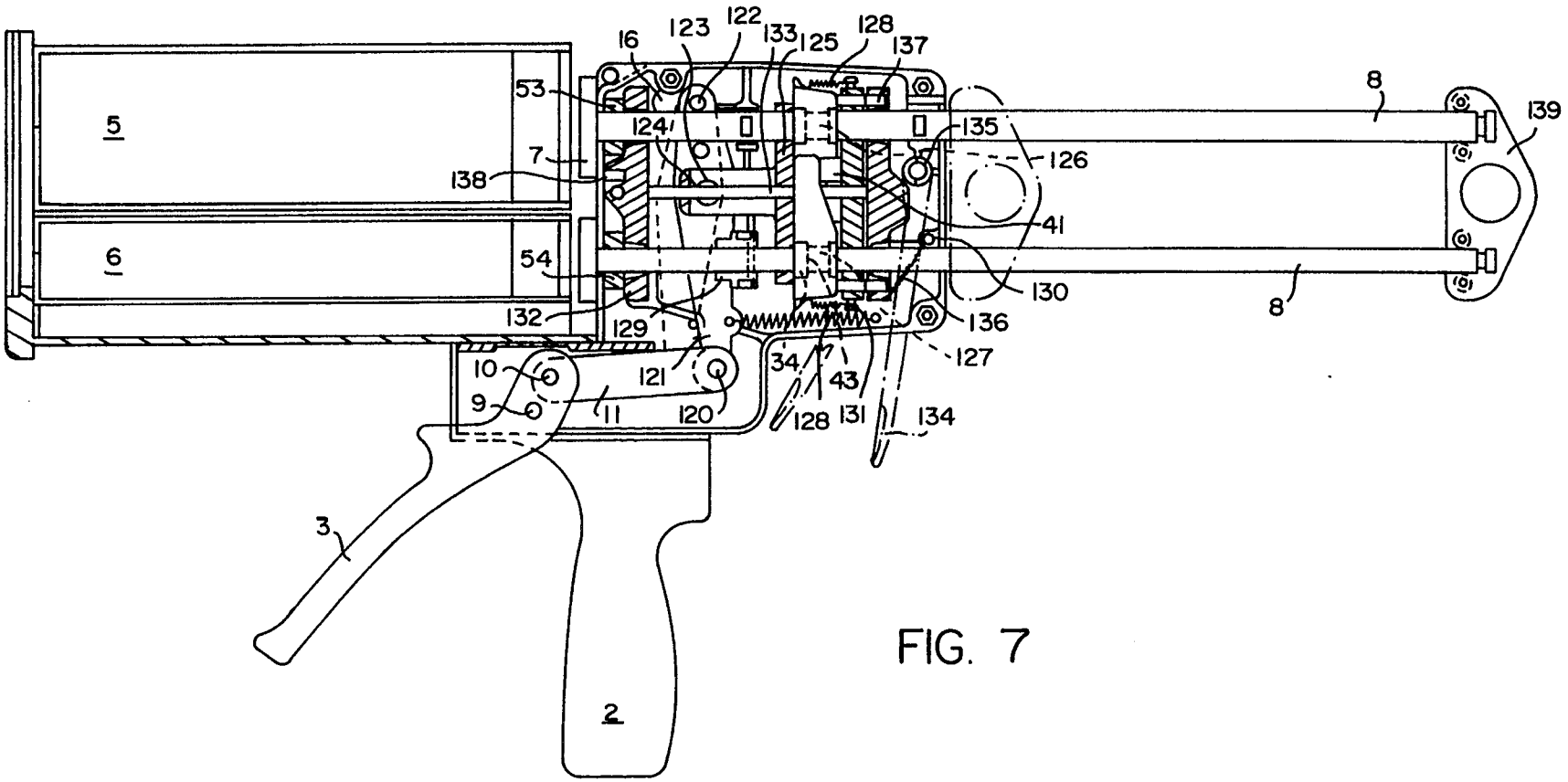
FIG. 7 shows a cross-section of a further embodiment of the invention.

The embodiment of FIG. 7 shows some simplifications. Handle 2 with trigger lever 3 as well as the double cartridge with the two cylinders 5 and 6 are the same as in the previous example. The same applies to the remaining component parts 7–11. Similarly as in the previous examples, traction bar 11 acts upon traction lever 121 by means of bearing neck 120, said traction lever being rotatively held in the housing in a stationary hinge pin 122 and being connected to traveller 125 by a bolt which slides in oblong hole 123. In addition to the bore for axle 122, a second bore is provided in the housing in order to allow a variation of the multiplication ratio. The guiding of the traveller is designed similarly as shown in FIG. 6.

In contrast to the previous embodiments, the two clamping levers 126 and 127 are arranged in traveller 125 on the same height, but in an obliquely opposed disposition with respect to the plane of the thrust rods, i.e. clamping lever 126 points backwards in the arrangement of FIG. 7. The actuation of the clamping levers by pegs 41 having a convex surface and bore 43 with pressure spring 34 is the same as in the previous examples, however with tension springs 128 instead of pressure springs 35 acting upon those ends of the clamping levers which are on the side of the thrust rods. Friction brake 129 is similar to friction brake 65 as to its action and design.

In particular, the embodiment of FIG. 7 provides a more effective unlocking of the return stop comprising locking levers 53 and 54, and of the clamping levers. This unlocking mechanism, which is effective in the case of a cartridge exchange or for a cartridge discharge to prevent an afterflow, comprises a first unlocking rocker 130 acting upon the clamping levers, and a second unlocking rocker 132 acting upon the locking levers. Said first rocker is connected approximately in its center to the second rocker by a guided rod 133. Said first rocker 130 is engaged by an unlocking lever 134 which is hinged on axle 135 and has a high multiplication factor. A return spring 136 is connected to said unlocking lever. For tolerance compensation purposes, said first rocker 130 comprises two adjustable threaded bolts 137 which act upon thrust pins 131 in the traveller when unlocking lever 134 is actuated, said pins in turn acting upon the clamping levers in order to set them to the straight, i.e. the ineffective position. In order to preload said rockers, second rocker 132 comprises a pressure spring 138 which rests on the housing.

When said unlocking lever is actuated, first rocker 130 acts upon the outer ends of the clamping levers by means of the adjustable threaded bolts 137 on the pins 131 in the traveller, on one hand, and by rod 133 directly upon second rocker 132, on the other hand, which actuates the locking levers, whereby both the clamping levers and the locking levers are unlocked in order to allow a free retraction of the thrust rods or a discharge of the cartridge tension.

If the thrust rods do not have equal diameters, the thicker thrust rod is rigidly guided, while the other thrust rod is guided with a slight play. In an alternative embodiment, bridge 139 is formed of two shaped pieces which seize thrust rods 8 without any play in the axial direction and with a little play in the radial direction and are screwed together.

As materials for the housing of the dispensing appliance as well as nearly all internal parts, usual lightweight materials can be used, preferably synthetic materials or light metals. The more stressed parts such as lever 13 and its bearing in the housing, pegs 41 and 42, etc., can be made e.g. of metal. The bearings as well as the bores in clamping and locking levers 30, 31 and 53, 54, respectively, and in traveller 26 can be provided with metal bushings, while the thrust rods may be manufactured of a correspondingly hard or surface-hardened material in order to avoid impact marks. The inside of the guidings and the surface of the thrust rods can be smoothened or polished in order to allow an easy gliding of the rods in the guidings. Nevertheless, the high clamping forces guarantee a sufficient driving force.

I claim:

1. A method for the even advance of thrust rods in a dispensing appliance, comprising the steps of:

providing a traveller having a plurality of bores therein, and a plurality of clamping levers having bores therein corresponding to the bores in the traveller, said clamping levers being movably mounted in said traveller;

guiding each thrust rod in a respective one of said bores of said traveller and a corresponding bore of one of the clamping levers;

tilting said clamping levers with respect to said thrust rods passing therethrough around an axis which is perpendicular to said thrust rods and thereby clamping said thrust rods in said bores;

receiving in said traveler bending moments which are thereby imparted to said thrust rods by the guiding of said thrust rods in the bores of said traveller during said clamping, said bending moments being received in said traveller in such a manner that they cancel each other; and advancing said thrust rods evenly while said bending moments cancel each other in said traveller.

2. A dispensing appliance for manually dispensing multiple component substances which are filled into cartridges, comprising:

a traveller which is movable forward and backward with respect to a dispensing direction;

clamping levers movably mounted in said traveller, said clamping levers each having a bore therein;

thrust rods each passing through a respective bore of one of said clamping levers;

thrust means associated with said traveller for engaging each of said clamping levers, said thrust means being disposed eccentrically with respect to the bore of the clamping lever engaged by the thrust means; and means for canting said clamping levers with respect to the respective thrust rod for clamping and driving the thrust rod along upon forward movement of said traveller.

3. The dispensing appliance of claim 2, wherein said means for canting comprise first spring elements serving to preload said clamping levers with respect to said traveller against the dipensing direction, in such a manner that said clamping can start without any play and simultaneously when said traveller moves forward.

4. The dispensing appliance of claim 2, wherein said clamping levers are arranged at the same distance in the dispensing direction from a dispensing end of said appliance.

5. The dispensing appliance of claim 2, wherein second spring elements are provided in order to press one respective clamping lever against the corresponding one of said thrust means.

6. The dispensing appliance of claim 2, wherein stop means are provided in order to selectively prevent any tilting of said clamping levers in the dispensing direction and thus a canting thereof which would hinder said advance.

7. The dispensing appliance of claim 2, wherein said thrust means are designed as projections projecting from the walls of said traveller in the advancing direction, said projections having convex surfaces provided with a hardened thrust surface.

8. The dispensing appliance of claim 2, wherein said thrust rods and at least part of the inside of said bores in said clamping levers are made of a hard material selected from the group consisting of hardened metals and polished metals.

9. The dispensing appliance of claim 2, further comprising a return stop comprising at least one friction brake acting upon at least one of said thrust rods and consisting of a body which is freely movable in a housing of the appliance across a small distance and which imparts a friction to said thrust rod, said small distance being limited by stop means which are secured to the housing of said appliance and acting upon said body.

10. The dispensing appliance of claim 2, further comprising a return stop comprising at least one spring-loaded locking lever associated with each thrust rod, said spring-loaded locking lever being provided with a bore through which a respective thrust rod passes and which movably engages in a recess of a housing of said dispensing appliance at a location which is offset with respect to the bore of the locking lever in order to cant with and block the respective thrust rod when the thrust rod moves backwards, and a forward stop provided on said locking lever in order to prevent a blocking of the forward motion of said thrust rod.

11. The dispensing appliance of claim 10, wherein locking means are provided for selectively holding said locking levers in a position in which said locking levers allow a return motion of said thrust rods.

12. The dispensing appliance of claim 11, wherein said locking means comprise a second unlocking rocker which is actuated by an unlocking lever and acts upon said locking levers.

13. The dispensing appliance of claim 12, wherein said unlocking lever acts upon a first unlocking rocker which is operatively connected to said second unlocking rocker by a connecting rod.

14. The dispensing appliance of claim 13, wherein said first unlocking rocker is both operatively connected to said clamping levers by adjustable threaded bolts as well as by thrust bolts which are guided in said traveller and connected to said connecting rod which acts upon said second unlocking rocker.

15. The dispensing appliance of claim 2, wherein said thrust rods are connected by a bipartite bridge which is formed of shaped injection-molded pieces.

16. The dispensing appliance of claim 2, wherein said cartridges comprise at least two storage cylinders having a ratio of cross-sectional areas in the range from 1:1 to 1:10.

17. An apparatus for the even advance of thrust rods in a dispensing appliance, comprising:

a traveler having bores therein through which said thrust rods are guided; and clamping levers movably mounted in the traveler, the clamping levers having respective bores through which said thrust rods are guided, the clamping levers tilting with respect to the thrust rods passing therethrough around an axis which is perpendicular to the thrust rods and clamping the thrust rods in the clamping lever bores, a bending moment which is thereby imparted to the thrust rods being received by the bores of the traveler, and torsional moments in the traveler resulting from the clamping levers cancelling each other when the advance resistance on the thrust rods are equal.

18. The dispensing appliance set forth in claim 2, wherein said thrust means comprise pegs mounted to said traveller, said pegs being disposed such that a bending moment created in said traveller by a first one of the pegs engaging a first one of the clamping levers is offset by a bending moment created in said traveller by a second one of the pegs engaging a second one of the clamping levers.

19. The dispensing appliance of claim 2, further comprising a return stop comprising at least one friction brake which is rigidly mounted in a housing of the dispensing appliance and which is capable of imparting a friction force to at least one of said thrust rods.

* * * * *